US006033095A

United States Patent [19]

Ognian

[11] Patent Number: 6,033,095

[45] Date of Patent: Mar. 7, 2000

[54] VEHICLE HEADLAMP HOUSING WITH CONNECTOR RECEIVING BREAKAWAY PORTIONS

[75] Inventor: Eric J. Ognian, Livonia, Mich.

[73] Assignee: North American Lighting, Inc., Farmington Hills, Mich.

[21] Appl. No.: 09/034,221

[22] Filed: Mar. 4, 1998

[51] Int. Cl.[7] ..... F21V 31/02

[52] U.S. Cl. ..... 362/375; 362/374; 362/546; 362/267

[58] Field of Search ..... 362/362, 374, 362/375, 507, 546, 267

[56] References Cited

U.S. PATENT DOCUMENTS

| | | | |
|---|---|---|---|
| 4,329,738 | 5/1982 | Heinz et al. | 362/520 |
| 4,574,338 | 3/1986 | Takasaki et al. | 362/278 |
| 4,695,928 | 9/1987 | Schauwecker et al. | 362/549 |
| 4,831,502 | 5/1989 | Fujino et al. | 362/518 |
| 4,931,912 | 6/1990 | Kawakami et al. | 362/547 |
| 5,021,930 | 6/1991 | Yamada | 362/539 |
| 5,072,348 | 12/1991 | Tsukada | 362/226 |
| 5,091,830 | 2/1992 | Suzuki | 362/539 |
| 5,113,331 | 5/1992 | Nagengast | 362/267 |
| 5,180,219 | 1/1993 | Geddie | 362/546 |
| 5,560,706 | 10/1996 | Yamazaki et al. | 362/549 |

*Primary Examiner*—Sandra O'Shea
*Assistant Examiner*—Ali Alavi
*Attorney, Agent, or Firm*—McDonnell Boehnen Hulbert & Bergnoff

[57] ABSTRACT

A headlamp assembly includes a housing and a lens. The housing forms an interior space to receive a lamp. A free or peripheral edge of the housing has a channel sized to receive an edge of the lens for attachment and sealing purposes. The channel includes breakaway portions formed at spaced apart intervals. The breakaway portions are spaced to align with spaced apart connectors extending from the edge of the lens. When mating the housing and lens, the channel is filled with adhesive and the free edge of the housing is joined with the edge of the lens. The connectors penetrate the breakaway portion as part of the joining step to interconnect the housing and lens. The connectors may be shaped to snap fit with the housing after penetration through the breakaway portion. The breakaway portion may be formed as part of the base of the channel or can be formed in a recess within the base.

18 Claims, 2 Drawing Sheets

VEHICLE HEADLAMP HOUSING WITH CONNECTOR RECEIVING BREAKAWAY PORTIONS

FIELD OF THE INVENTION

The present invention is directed to a vehicle headlamp housing and lens assembly and, in particular, to a housing having a breakaway portion as part of a housing channel to facilitate housing connection to the lens.

BACKGROUND ART

In the prior art, various types of headlamp assemblies for vehicles have been proposed. One type employs clips to secure the headlamp lens to the headlamp housing as illustrated in FIG. 1. This assembly, designated by the reference numeral 10, includes a housing 1 and a lens 3. The housing 1 and lens 3 cooperate to form a sealed space 5 for a headlamp 7.

The housing 1 has a wall portion which terminates in a free edge 11. The edge 11 includes a groove 13 that functions to receive the edge 15 of the lens 3 as well as an adhesive (not shown) for attachment and sealing purposes.

The lens 3 is secured to the housing 1 via clips 17, the clips 17 cooperating with protrusions 19 of the housing 1 and protrusions 21 of the lens 3.

FIG. 2 illustrates another type of headlamp assembly designated by the reference numeral 10'. In this assembly, rather than using clips 17 to attach the housing and lens together, the lens 3' has a connecting member 22 extending therefrom. The connecting member 22 is sized to be inserted into a throughopening 23 in the housing 1'. When the connecting member 22 is inserted into the throughopening 23, the lip 25 thereof engages the surface 27 of the housing 1' to lock the lens in place. A plurality of throughopenings 23 are spaced apart along the housing free edge 11'. In addition, the FIG. 2 embodiment may also employ an adhesive where the edge of the lens 3' mates with the groove 13' of the housing 1'.

The prior art headlamp assemblies depicted in FIGS. 1 and 2 are not without their drawbacks. Often times, the clearances between the headlamp assembly and vehicle body parts may prevent the employment of one or more clips or the like. In headlamp assemblies employing a throughopening such as that depicted in FIG. 2, adhesive leakage can occur, thereby potentially compromising the integrity of the sealed space of the headlamp assembly. Other headlamp assemblies require complex manufacturing tooling such as slides and/or retractors which make the headlamp assembly expensive to manufacture.

As a result of the above-noted disadvantages, a need has developed to provide an improved headlamp assembly. In response to this need, the present invention provides a headlamp assembly which does not require the use of clips or the like to facilitate attachment of a headlamp housing to a lens. In addition, the present invention minimizes or eliminates leakage of the adhesive normally employed to connect headlamp housings and lenses together.

SUMMARY OF THE INVENTION

Accordingly, it is a first object of the present invention to provide an improved headlamp assembly.

Another object of the present invention is to provide a headlamp assembly which is easily manufactured and assembled.

A still further object of the present invention is a headlamp assembly adapted to fit into locations having small clearances.

One other object of the present invention is to provide a headlamp assembly which minimizes adhesive leakage during assembly.

Yet another object of the invention is a headlamp assembly that is easily molded.

Other objects and advantages of the present invention will become apparent as a description thereof proceeds.

In satisfaction of the foregoing objects and advantages, the present invention provides a headlamp assembly comprising a headlamp housing having an interior space and a free edge surrounding the interior space. The free edge includes a channel, a base of the channel including a plurality of spaced apart breakaway portions. The breakaway portions are constructed such that they can be easily penetrated or broken away upon application of force such as a connector driven thereagainst. In one embodiment, the portions are of thinner gauge than the channel base sections to facilitate the penetration or breakaway action.

The headlamp assembly also has a headlamp lens with a peripheral free edge sized to engage the housing channel to enclose the interior space of the headlamp housing. The peripheral edge includes a plurality of connectors extending therefrom and being spaced apart along the peripheral edge so that each connector can penetrate a respective breakaway portion to attach the lens to the headlamp housing.

The breakaway portion may be formed as part of the actual base or may be formed as part of the base of a recess extending from the channel base. The breakaway portion may extend between sections of the channel wall or from one or opposing channel wall section protrusions. Preferably, the breakaway portion is formed as molding flash formed when molding the headlamp housing or as another thin gauge construction to permit the connector to easily penetrate the breakaway portion during lens and housing mating.

The breakaway portion, having a generally nonporous structure, also functions to retain any adhesive placed within the channel. Adhesive leakage is minimal since the connector is sized so that it occupies the opening or space left when the breakaway portion is removed.

The connector is preferably configured to snap fit during attachment of the lens and housing. In one embodiment, the connector is flexible, e.g., partially separated from and angled differently than adjacent surfaces of the lens when at rest. The connector is also provided with a beveled surface-containing shoulder on its distal end. In this way, the connector, when sliding into the channel, is biased inwardly by contact between the bevel on the shoulder and the housing. When the distal end penetrates the breakaway portion, the shoulder emerges from the channel with the connector biasing outwardly against a channel wall surface. The shoulder also contacts a shoulder-engaging surface of the housing thereby forming a snap fit. The connector can have other configurations, e.g., one containing ribs or the like, or a pin-type configuration to facilitate attachment to the housing.

The invention also includes just the headlamp housing with the breakaway portions alone. In this embodiment, the breakaway portions could be configured to receive connectors of various types of lenses.

BRIEF DESCRIPTION OF THE DRAWINGS

Reference is now made to the drawings of the invention wherein.

DESCRIPTION OF THE PREFERRED EMBODIMENTS

The inventive vehicle headlamp assembly overcomes many of the disadvantages present in prior art headlamp assemblies. The present invention eliminates the use of metal clips or the like to connect a headlamp lens and a headlamp housing. In addition, due to its simplified design, the inventive headlamp assembly does not require complex tooling such as slides and retractors when manufacturing the components by molding techniques. In addition, by eliminating clips for attachment purposes, the inventive headlamp assembly can be employed in vehicles having limited space availability for headlamp installation.

Figure 1:
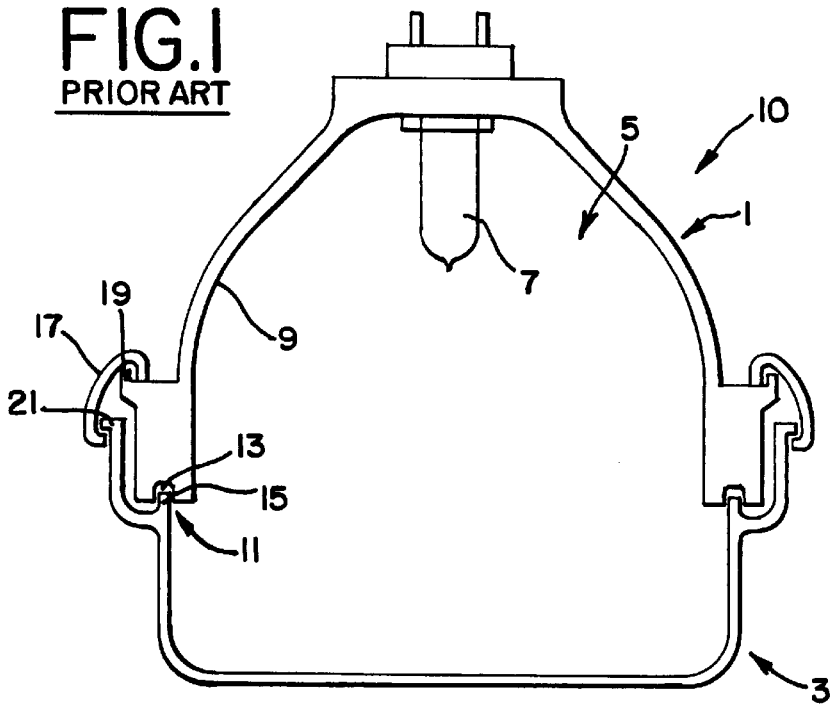
FIG.1 PRIOR ART
FIG. 1 is a sectional view of a prior art headlamp assembly.
Figure 2:
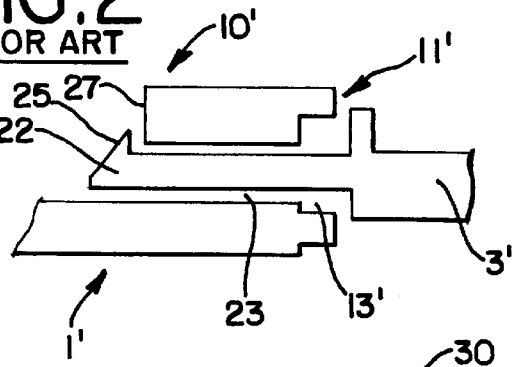
FIG.2 PRIOR ART
FIG. 2 is partial sectional view of another prior art headlamp assembly.
Figure 3:
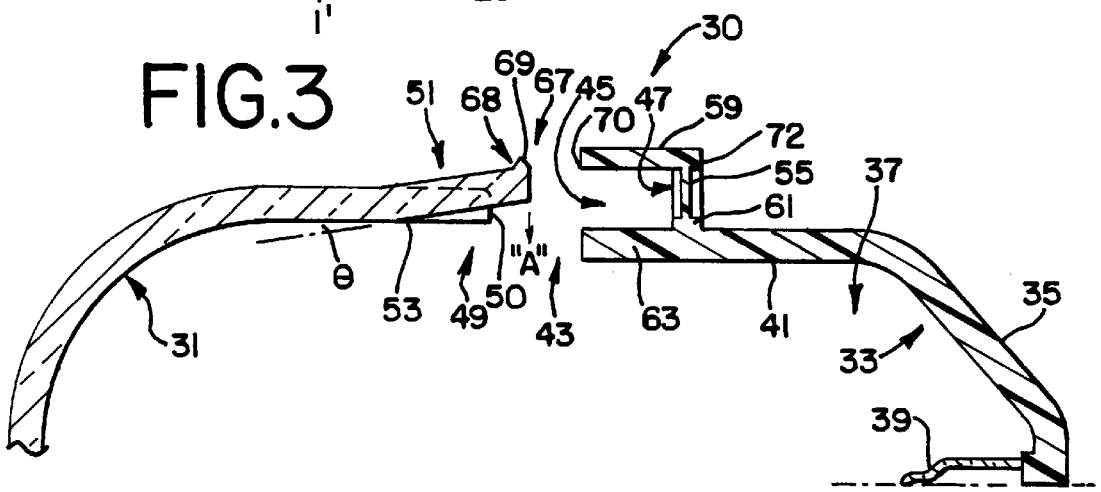
FIG. 3 is a cross sectional view of an unassembled first embodiment of the inventive headlamp assembly.
Figure 4:
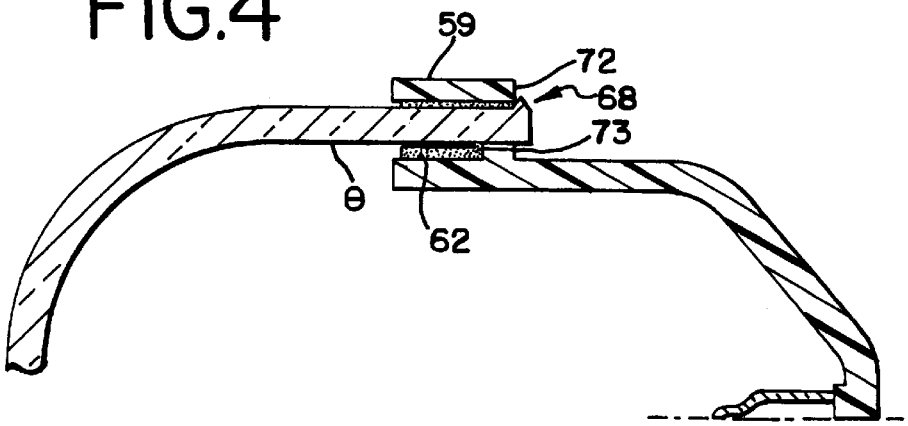
FIG. 4 is the embodiment of FIG. 3 in an assembled state.
Figure 7:
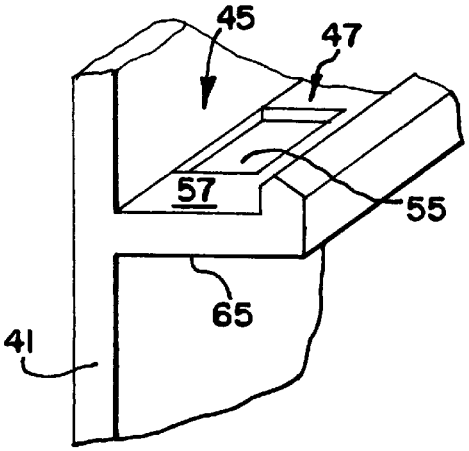
FIG. 7 shows a perspective view of a portion of the headlamp housing of the embodiment of FIG. 3 with portions broken away to show more detail.

One embodiment of the inventive headlamp assembly is depicted in FIGS. 3, 4 and 7. With particular reference to FIG. 3, the headlamp assembly is generally designated by the reference numeral 30 and includes a lens 31 and a headlamp housing assembly 33. The headlamp housing assembly 33 comprises a housing 35 forming an interior space 37 and a headlamp 39. The lens 31 and housing 35 can be made of any materials adaptable for headlamp assembly use, e.g., polymers or the like. It should be understood that FIGS. 3 and 4 depict only a portion of the headlamp assembly since the actual configuration of the lens and portions of the housing assembly 33 can be varied as is required by a particular vehicle need or headlamp design. For example, the lens 31 could be symmetric or asymmetric and the housing assembly 33 could include dual housings or a reflector if so desired. In addition, since each of the lens 31 and housing 35 has a continuous peripheral edge, the view depicted in FIGS. 3 and 4 is representative of the entire periphery. Of course, the actual shape of the lens and housing may vary along their respective peripheries if the assembly is not symmetric about its midpoint or centerline.

The housing 35 includes a wall 41 terminating in a free edge 43. As stated above, the edge 43 is peripheral in nature with the wall 41 being continuous and surrounding the lamp 39.

The free edge 43 includes a channel 45, the channel having a base 47.

The lens 31 also has a free or peripheral edge 49. The edge 49 includes a plurality of spaced-apart connectors 51. Each connector 51 extends beyond the terminal face 50 of the edge 49 and has a generally rectangular transverse cross section. The edge 49 is sized to correspond with the edge 43 of the housing so that the lens and housing can effectively mate and seal the interior space 37.

The connector 51 is angled with respect to the inner surface 53 of the lens 31, the angle difference represented by $\theta$. With this configuration, the connector 51 can be forced in the direction "A" see FIG. 3, so as to generate a bias in a direction opposite of "A" for a snap attachment as more fully described hereinbelow.

As noted above, a plurality of connectors are located and spaced apart in intervals along a periphery of the lens edge 49. The number of connectors can vary depending on the headlamp assembly configuration.

Referring again to the housing 35, the channel 45 also includes a breakaway portion 55 as part of the base 47. The term "breakaway" is defined as a portion of the channel which is of a construction such that a force applied thereto, e.g., by a connector driven manually or by machine, would cause penetration of the breakaway portion, such penetration leaving an opening where the breakaway portion was located. The breakaway portion 55 is shown in FIGS. 3 and 7 as being slightly recessed from the surface 57 of the base 47. The breakaway portion 55 is also shown extending between the channel wall section 59 and a protrusion 61 extending from the opposite wall section 63.

As can be seen from FIGS. 3 and 7, the breakaway portion 55 has a reduced thickness as compared with the base 47 thickness as measured between the surface 57 and a base underside surface 65. A number of breakaway portions 55 are located along the edge 43 in alignment with the connectors 51 extending from the lens edge 49. With this alignment, when the lens 31 is mated with the housing 35, each breakaway portion 55 interfaces with the connector 51 for attachment of the lens 31 to the housing 35.

Prior to mating of the lens 31 with the housing 35, the channel 45 can be filled with an adhesive, e.g., butyl (not shown in FIG. 3). The adhesive functions to retain the lens edge 49 in the channel 45 so that a sealed interior space is formed after lens and housing mating. The adhesive is retained in the channel 45 by the channel base 47 and the breakaway portions 55. Since the channel and the breakaway portions are generally non-porous, the adhesive cannot leak out of the channel as may occur in prior art headlamp assemblies using throughopenings for connector attachment.

Referring now to FIGS. 3 and 4, once the adhesive 66 is applied, the lens edge 49 is inserted into the channel 45 for a snap fit. The snap fit is achieved, in part, by the shoulder 68 formed at the distal end 67 of the connector 51. The shoulder 68 includes a beveled surface 69 which contacts the edge 70 of the wall section 59. While the distal end 67 is being inserted into the channel 45, the contact between the beveled surface 69 and edge 70 biases the connector 51 in the direction "A" so that the connector 51 and edge 49 are inserted into the channel 45. This biasing results in a smaller angle $\theta'$, than prior to assembly as depicted in FIG. 3. Continued insertion of the lens edge 49 into the channel 45 causes the distal end 67 to contact the breakaway portion 55. Further insertion causes the distal end 67 to break through the portion 55 and the face 50 to rest against the base surface 57 (see FIG. 7). After break through, the distal end 67 passes through the opening left by removal of the breakaway portion such that the bias applied to connector 51 is released and the shoulder 68 engages the surface 72 of the wall section 59. With this configuration, the connector remains biased against the wall section 59 since $\theta'<\theta$ and the lens 31 is effectively snapped into the channel 45. Further, the distal end 67 of the connector, being sized to generally match the size of the breakaway portion 55, effectively occupies the opening 73 formed by removal of the breakaway portion 55. Thus, adhesive 66 located in the channel is effectively blocked from leaking from around the connector distal end 67 and out of the channel 45.

It should be understood that the snap connector attachment depicted in FIGS. 3, 4 and 7 is a preferred embodiment of the invention. That is, other connector configurations and breakaway portion configurations can be utilized providing that the connector can break through the channel to form some degree of attachment with the housing and also plug the opening made after the connector penetration.

Figure 5:
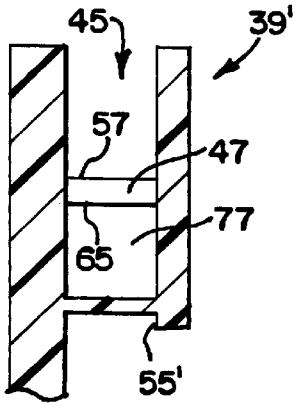
FIG. 5 is a partial cross sectional view of second embodiment of the inventive housing as part of the headlamp assembly.
Figure 6:
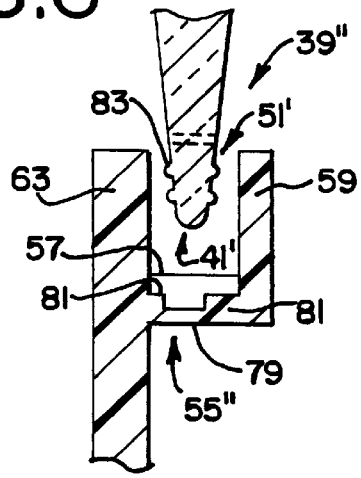
FIG. 6 is a partial cross sectional view of another connector embodiment with yet a third housing embodiment in an unassembled state.

Referring now to FIGS. 5 and 6, alternative embodiments for the breakaway portion 55 and connector 51 are disclosed. In FIG. 5, a recess 77 is formed beneath the base 47, a breakaway portion 55' forming the base of the recess 77. In this configuration, the base 47 would have an opening which would receive the connector 51 and the connector 51 would be sized in length to extend through the opening in the base 47 and through the breakaway portion 55 to achieve the snap connection.

FIG. 6 shows another type of breakaway portion 55" which is positioned between opposing protrusions 81 of the wall sections 59 and 63. In this embodiment, the surface 79 of the breakaway portion 55" is coincident with the surface 65 of the base. This contrasts with the embodiment shown in FIG. 7 wherein the breakaway portion 55 is shown disposed between the surfaces 47 and 65.

FIG. 6 also shows a connector 51' having ribs 83, the ribs 83 interfacing with the opening left by the breakaway portion 55" for a press fit attachment. Other press fit configurations for the connector and breakaway portion can be employed.

As noted above for one of the preferred embodiments of the invention, other types of configurations of the connector 51 or 51 and breakaway portions 55, 55' and 55" to achieve different types of attachment between the lens and the housing are within the scope of the invention. For example, the connector could be formed with a pin-like configuration or in the form of a tab (with or without a shoulder) having an oval, square or other shaped transverse cross sectional configuration.

The breakaway portion 55 can be made in any manner so that when a force is applied thereto by a particular connector, the portion 55 "breaks away" from the housing. A preferred mode of making the breakaway portion includes molding techniques wherein the channel is molded and molding flash is formed at the location of each breakaway portion. Since molding flash is a thin gauge by-product of the molding process, the connector can easily break through the flash when the lens is being mated with the headlamp housing. The breakaway portion 55 could also vary in thickness if so desired, e.g., tapered, stepped or the like.

Figure 8:
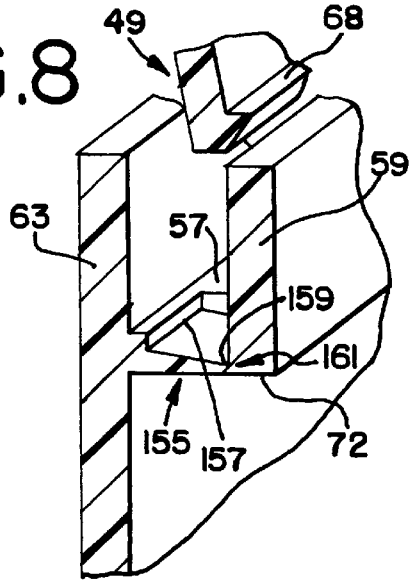
FIG. 8 is a sectional view of yet another embodiment of the invention.

FIG. 8 shows another embodiment of the breakaway portion as reference numeral 155. The portion 155 is shown positioned between the wall sections 59 and 63 and having a tapered configuration. More particularly, the portion 155 tapers in thickness from edge 157 to edge 159 so that the thickness at edge 159 is less than the thickness at edge 157. With this configuration, the portion 155 functions like a hinge when contacted by the edge 49 of a lens, whereby the area 161 breaks away initially. Having the area 161 break away first facilitates the snap fit between the shoulder 68 of the edge 49 and the undersurface 72 of the wall section 59 as described above. Although the portion 155 is depicted with a tapering thickness, other cross sectional configurations can be used, e.g., a stepped design, to initiate break away in the area 161.

Molding techniques are also preferred to form the housing and the lens. As stated above, the housing is preferably molded so that the breakaway portion can be formed as molding flash. The configuration of the connector depicted in FIGS. 3 and 4 permits the use of a two-part mold for lens formation, thus making the manufacturing operation more cost-effective. A similar type molding operation can be employed to form the housing with the breakaway portion. In addition, since the molding techniques are simplified, cheaper materials such as polypropylene can be used when manufacturing the housing assembly.

The housing 35 containing the breakaway portion 55 could be utilized with existing lenses. That is, the breakaway portion could be configured, located or sized to interface with the connector member of a known lens design. For example, the housing could be made so that its edge corresponds to the lens edge with the breakaway portions effectively interfacing with the connector members of the lens for attachment.

As such, an invention has been disclosed in terms of preferred embodiments thereof which fulfills each and every one of the objects of the present invention as set forth above and provides a new and improved headlamp housing and headlamp assembly.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A headlamp assembly comprising:

a) a headlamp housing having an interior space and a free edge surrounding the interior space, the free edge including a channel, a base of the channel including a plurality of spaced apart breakaway portions; and b) a headlamp lens with a peripheral edge sized to engage the channel to enclose the interior space of the headlamp housing, the peripheral edge including a plurality of connectors extending therefrom and being spaced apart along the peripheral edge so that each connector can penetrate a respective breakaway portion to attach the lens to the headlamp housing.

2. The assembly of claim 1, wherein the base of the channel includes a recess, the breakaway portion forming at least a portion of the recess base.

3. The assembly of claim 1, wherein a distal end of the connector has a shoulder and the headlamp housing has a shoulder-engaging surface adjacent the breakaway portion.

4. The assembly of claim 1, wherein the breakaway portion is sized to form a press fit between the connector and an opening formed after connector penetration of the breakaway portion.

5. The assembly of claim 1, further comprising an amount of an adhesive in the channel.

6. The assembly of claim 1, wherein the connector is flexible so as to form a snap fit when the connector penetrates the breakaway portion.

7. The assembly of claim 6, wherein a distal end of the connector has a shoulder and the headlamp housing has a shoulder-engaging surface adjacent the breakaway portion.

8. The assembly of claim 7, wherein the shoulder has a beveled surface arranged to contact a portion of the headlamp housing and to bias the connector in a first direction while the distal end passes through the channel, penetration of the breakaway portion by the distal end permitting the shoulder to contact the shoulder-engaging surface and the connector to bias against a channel surface in a direction opposite the first direction to attain the snap fit.

9. The assembly of claim 6, wherein an inner surface of the connector is angled differently than a surface of the headlamp lens adjacent the inner surface.

10. The assembly of claim 9, wherein the connector has a generally transverse rectangular cross section.

11. The assembly of claim 1, wherein the base of the channel includes a recess, the breakaway portion forming at least a portion of the recess base, a distal end of the connector has a shoulder and the recess base has a shoulder-engaging surface adjacent the breakaway portion.

12. The assembly of claim 11, wherein the connector is flexible so as to form a snap fit when the distal end of the connector penetrates the breakaway portion and the shoulder contacts the shoulder engaging surface.

13. The assembly of claim 12, wherein an inner surface of the connector is angled differently than a surface of the headlamp lens adjacent the inner surface.

14. The assembly of claim 13, wherein the connector has a generally transverse rectangular cross section.

15. The assembly of claim 1, wherein the breakaway portion has a thickness less than a thickness of the base of the channel.

16. The assembly of claim 1, wherein the housing is a molded polymer and the breakaway portion is formed from molding flash.

17. The assembly of claim 1, wherein each breakaway portion has a tapered cross sectional shape.

18. A headlamp assembly comprising:

a) a headlamp housing having an interior space and a free edge surrounding the interior space, a base of the channel including a plurality of spaced apart breakaway portions made of molding flash; and b) a headlamp lens with a peripheral edge sized to engage the channel to enclose the interior space of the headlamp housing, the peripheral edge including a plurality of connectors, each connector extending beyond the peripheral edge and being spaced apart along the peripheral edge, each connector being tab-shaped with a generally rectangular transverse cross section, a distal end of the connector having a beveled surface-containing shoulder to snap fit with the housing after connector penetration of the breakaway portion.

* * * * *